US005287879A

United States Patent [19]

Leggett et al.

[11] Patent Number: 5,287,879

[45] Date of Patent: Feb. 22, 1994

[54] HYDRAULICALLY ENERGIZED WIRELINE BLOWOUT PREVENTER

[75] Inventors: Henry H. Leggett, Hallsville, Tex.; Lionel M. Gingras, Vancouver, Canada; Russell C. Gilleylen, Longview, Tex.

[73] Assignee: Eastern Oil Tools Pte Ltd., Singapore, Singapore

[21] Appl. No.: 46,980

[22] Filed: Apr. 13, 1993

[51] Int. Cl.[5] ..... E21B 33/06

[52] U.S. Cl. ..... 137/246.22; 251/1.3

[58] Field of Search ..... 251/1.3; 137/246.22

[56] References Cited

U.S. PATENT DOCUMENTS 4,290,578 9/1981 Earp et al. ..... 137/246.22 X
4,583,569 4/1986 Ahlstons ..... 251/1.3 X
4,976,402 12/1990 Davis ..... 251/1.3

*Primary Examiner*—John C. Fox
*Attorney, Agent, or Firm*—James L. Jackson

[57] ABSTRACT

A single ram wireline BOP mechanism is disclosed which incorporates opposed rams having elastomeric packing capsules and outer elastomeric seals for accomplishing sealing about a wireline extending through the BOP body. The packing capsules cooperate to define a centrally oriented grease chamber into which is injected grease from an externally accessible grease fitting so as to establish grease sealing about the wireline. Grease pressure from the grease chamber is ducted through the BOP rams and into inner cylinders where it acts upon the pressure responsive area of a free piston contained therein. The grease pressure develops a force on the free piston which acts against the ram to enhance the closing force of the ram. The free piston has a pressure responsive area significantly greater than the pressure responsive area of the packing capsule portion of the ram so that grease pressure acting upon both of these components develops a significant resultant force that enhances the closing force and thus sealing capability of the rams. The rams are also operated in the closing and opening directions by hydraulic fluid which is introduced through fittings into an outer hydraulic cylinder. The BOP mechanism is also provided with a non-rising stem type lock out device which drives a lock nut for securing the ram energizing piston in its closed position when desired. The apparatus also incorporates a position indicator stem which is coupled with the ram energizing piston so that the position of the piston and rams may be visually inspected.

30 Claims, 7 Drawing Sheets

FIG. 10
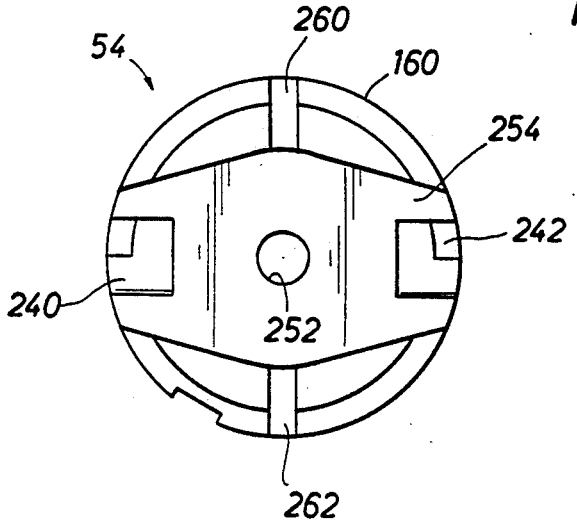
FIG. 11
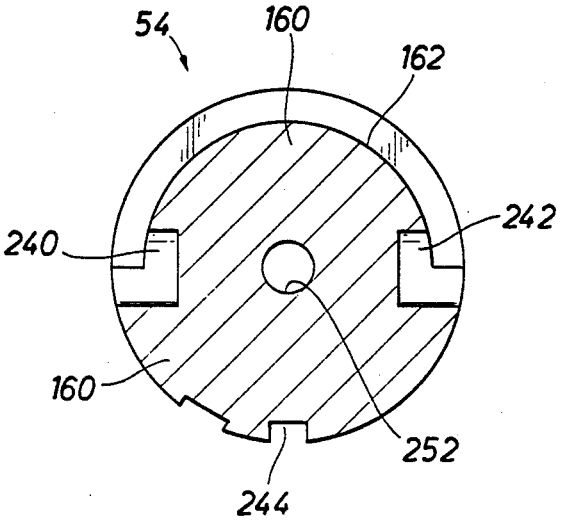
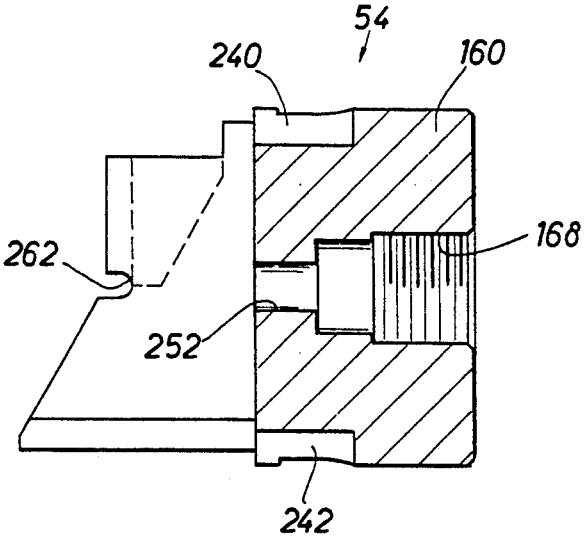
FIG. 12
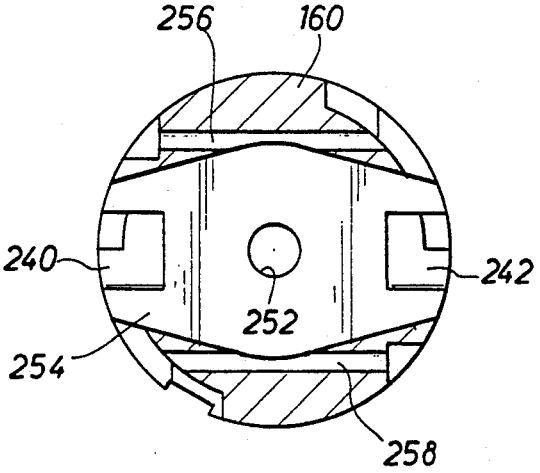
FIG. 13

FIG. 14
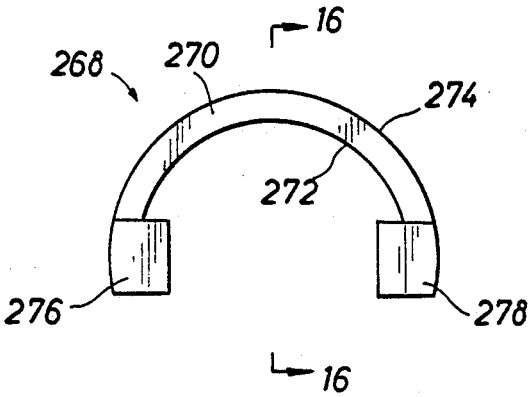
FIG. 15
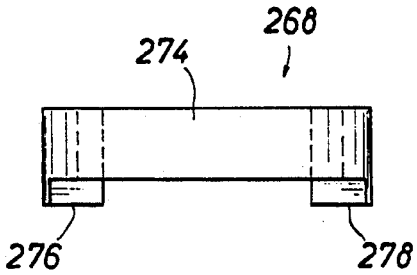
FIG. 16
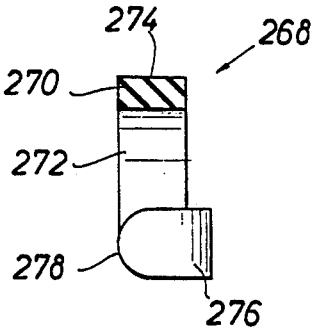
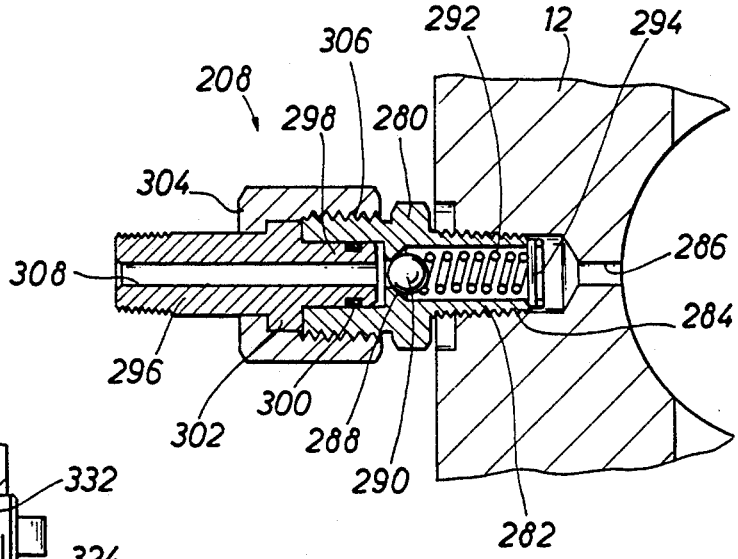
FIG. 17
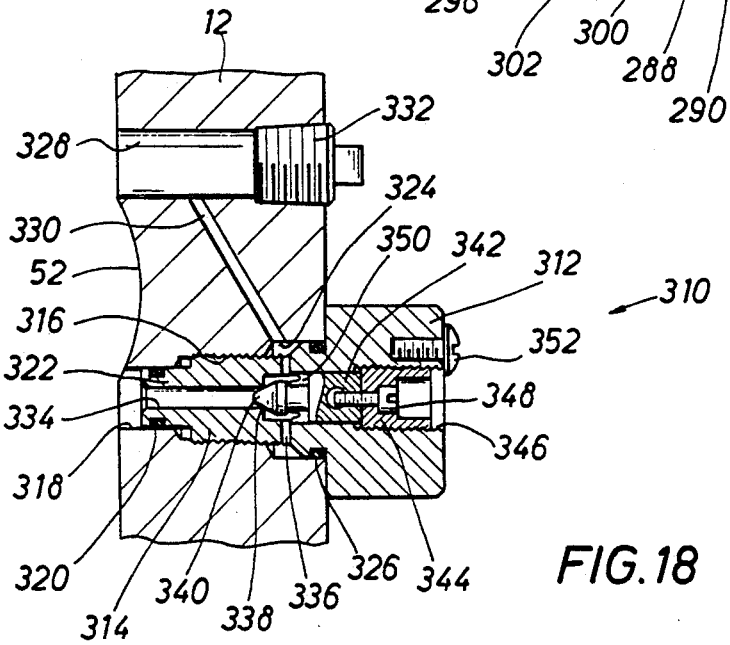
FIG. 18

HYDRAULICALLY ENERGIZED WIRELINE BLOWOUT PREVENTER

FIELD OF THE INVENTION

This invention is related generally to blowout preventers and more specifically concerns blowout preventers designed specifically for sealing about the wireline of wireline tools such as are utilized for conducting well servicing operations. Even more specifically, this invention concerns a hydraulically operated and well pressure energized wireline blowout preventer that incorporates grease enhanced sealing for establishment of a seal about a wireline and within the interstices that exist between the armor strands of a typical wireline.

BACKGROUND OF THE INVENTION

After a well has been drilled such as for discovery and production of petroleum products, wireline controlled apparatus is frequently employed to conduct various downhole installation, retrieval and servicing operations. Wireline equipment is utilized to install and retrieve a wide variety of downhole tools such as packers, gas lift valves, downhole safety valves, bottom hole pressure sensors and the like. Wireline equipment is also frequently utilized to run various well servicing tools such as for cleaning and treating production tubing.

At times it is desirable to establish a seal about the wireline to permit well servicing operations to be conducted within the wellhead and free of well pressure above the blowout preventer (BOP). More importantly, wireline BOP's are required to accommodate various emergency situations and alleviate any dangerous condition that might otherwise occur. During wireline operations the wireline BOP is typically static in an open position which allows the wireline to freely traverse the wellhead of the well without interference with any portion of the wellhead structure including the safety equipment of the wellhead.

At times during well servicing operations it will be necessary to close and seal the wireline BOP about the wireline. For example, in the event a kick (pressure surge) develops in the open hole or in the casing of the well, the wireline BOP is closed in response to the kick to develop a seal about the wireline to contain well pressure and prevent a blowout. With well pressure thus contained kill fluid can be pumped into the well below the seal established by the wireline BOP to shut in the well to thus permit other well servicing operations to be safely conducted. The wireline BOP may also be closed to temporarily contain the well pressure while bleeding well pressure off the lubricator of the wireline equipment to thus permit replacement of the packoff elements of the lubricator. In some cases it becomes necessary to remove, add or make repairs to the riser or cable of the wireline well servicing equipment. In this case the wireline BOP is typically closed and sealed about the wireline cable to thus contain the well pressure and permit cable repairs to be made above the level of the wireline seal. Most critically, wireline BOP's are shut automatically or manually in the case of failure of the well control system above the level of the BOP and thus must develop an efficient seal about the wireline to prevent any leakage from occurring.

Typically, wireline sealing elements are formed by two elastomer faced metal rams which have been contoured to fit a particular size of wireline cable. These rams are positioned in opposed relation and are actuated such that they accomplish centering of the wireline and establish sealing engagement with the wireline at a location that is centrally of the BOP housing. The opposed rams are closed manually or hydraulically (with mechanical backup) to develop a positive seal about the wireline to contain the well pressure and thus shut in the well. When the BOP is activated, the elastomer faces of the rams will seal around the outer surface of the cable by extruding the elastomeric material into the interstitial spaces between the armor strands of the wireline. When pressurized grease is present between the rams of a BOP its pressure, acting on the pressure responsive force area of each ram tends to oppose the closing force of the ram. This problem can be overcome to some extent by venting excess grease pressure from the faces of the rams as is taught in Applicant's earlier U.S. Pat. No. 4,938,290. It is desirable to provide for utilization of the grease pressure for enhancing the sealing capability of the rams.

Ram type BOP's are designed to seal with the wireline cable in a static position. Especially for the reason that the extruded elastomer material in the interstices of the cable strands is easily torn away by relative cable movement, it is necessary therefore to always stop movement of the wireline before the rams are closed about the wireline to effect sealing. Short lengths of wireline cable can be stripped through the BOP as needed to repair a stranded cable but the amount of elastomeric material that can be worn away by such stripping without resulting in leakage of the BOP is limited. Pulling an appreciable length of wireline cable through the BOP will induce severe wear to the elastomeric seals of the rams and can cause damage to the rams as well, thus causing a more serious failure.

The highly pressurized elastomeric seal is prevented from extrusion by the close metal-to-metal fit of the ram faces and due to the fact that differential pressure moves the cylindrical rams tightly against the upper wall of the BOP housing. When the pressure of the elastomer against the surrounding surfaces of the BOP body exceed differential pressure a leak-tight seal will be effected. Wireline BOP's are designed to seal against well pressure in only one direction and therefore care must be taken to insure that they are not installed upside-down when a single set of rams is employed because an invested BOP will not hold well pressure. Single ram BOP's are only installed upside-down to contain pressure injected from above. Thus inverted single ram BOP's are virtually always used above a BOP that can contain well pressure.

It is difficult to move the rams of wireline BOP's when the rams are closed against high differential pressures. Wireline BOP's must therefore be provided with a bypass that is used to equalize the pressure across the rams before opening of the rams is initiated. After equalization of well pressure across the rams has occurred there will be a partial relaxation of the sealing contact of the elastomeric seals with the wireline, thus reducing the extrusion of the elastomeric sealing material about the wireline and as a consequence, reducing the friction between the sealing material and the wireline. This effective reduction of friction makes the rams much easier to open. To allow a controlled equalization of pressure, the BOP is typically fitted with a pressure equalizing system that is externally controllable to enable efficient operation by service personnel.

Manual BOP's are typically operated by selectively turning two ram operator handles on opposed sides of the apparatus to open and close the opposed rams. Manual BOP's are available in a number of sizes and ratings. Regardless of the pressure rating, they are normally used at lower pressures for standard service. Manual BOP's are typically of lighter weight and are less expensive as compared to BOP's having hydraulically energized rams. Because operating personnel must gain physical access to manual BOP's for opening and closing the rams, these persons are typically in a more dangerous location, i.e. immediately adjacent the wellhead, during BOP operation. Also, less ram pressure can be applied with manual BOP's than with hydraulically energized ram BOP's. In larger sizes, as commonly used for open hole work, the manual BOP offers adequate protection and is considerably lighter than a hydraulically energized BOP.

Hydraulic ram BOP's are opened and closed by hydraulic pressure acting on ram operating pistons that are located within hydraulic cylinders. Hydraulic BOP's are also typically provided with operating handles and stems which are used for manual backup. A hydraulic BOP can generally be closed manually but usually must be opened hydraulically. The manual operating stems must be backed out manually to allow hydraulic piston movement before the rams can be opened hydraulically.

The rams and sealing elements of wireline BOP's have grooves that are sized for the wireline cable diameter being employed. As the rams are closed, the wireline cable is guided by the rams or other cable guide elements into the grooves of the sealing elements. Wireline BOP's are provided with "integral guide" rams that prevent cable damage as the cable is guided and centralized during ram closure. If the rams of hydraulic wireline BOP's are to be left closed for a long period of time or in case of hydraulic failure, the manual screw jacks defining the manual operating stems can be used to secure the rams in the closed position and prevent inadvertent piston and ram movement. To open a hydraulic wireline BOP, the mechanical backup must be in the open position before shifting the hydraulic "selector" to its open position and hydraulically forcing the rams to their open positions by means of hydraulic fluid pressure.

Multiple ram BOP's, typically dual wireline BOP's, are utilized to provide a backup in case of failure of the primary set of sealing rams. More importantly is the fact that gas tends to migrate through the interstices between the inner and outer armor of the wireline cables. In the event that the lubricator of the wireline equipment should need to be removed for some reason, any natural gas leakage through the interstices of the standard cable could quickly present a significant problem from the standpoint of danger to personnel because of its explosive nature. To alleviate this problem, a second (tandem) BOP is typically added. This BOP is inverted (because wireline BOP's hold pressure in only one direction) and an injection port is provided between the two BOP's. High pressure grease (above well pressure) is then injected into the flow passage between the upper and lower sets of rams. Under high pressure, the grease is caused to migrate into the interstitial space between the inner and outer armor of the wireline and thereby effects a grease seal to prevent gases from escaping. In some cases a triple BOP is also installed to provide a backup in the case of primary ram failure. A triple BOP also provides a method for injecting grease between the BOP's if needed. Obviously the BOP riser becomes quite high when triple BOP's are installed in tandem. Multiple ram BOP's are available in a single forged body for lighter weight and more compact size if BOP riser height becomes a problem.

As explained above, it is frequently necessary to employ dual and sometimes triple wireline BOP's and to provide for grease injection between them in order to effect a proper wireline seal and prevent migration of gases through the interstices of the wireline. Since the flow passage between the stacked or multiple wireline BOP's is typically of significant length and is at least as great as the diameter of the flow passage through the wireline extends, a considerable volume of injected grease is necessary to fill the flow passage to accomplish efficient sealing. Also, injection of a sufficient volume of grease to fill the flow passage and develop a hydraulic seal with the wireline can require a considerable period of time. It is desirable therefore to minimize the time required to develop an adequate hydraulic seal with the wireline to thus promote the safety of the sealing operation. Obviously, employment of dual and triple ram BOP's, whether of the manual or hydraulic type, can result in considerable expense. Moreover, the stacking of dual and triple wireline BOP's ordinarily results in a BOP riser of significant height. In many cases there is little room to accommodate multiple wireline BOP's of this nature. Accordingly, it is desirable to provide a single ram wireline BOP having the capability of providing both elastomeric sealing by means of opposed rams and to provide hydraulic sealing by means of grease injection. Additionally it is desirable to provide for pressure enhanced sealing of a wireline BOP by means of the pressure of injected sealing grease.

As indicated above, to provide a wireline BOP system with the capability of accomplishing ram energized elastomer sealing with a wireline and to accomplish grease sealing of the wireline typically requires two or more wireline BOP's that are coupled to define a BOP riser with a large volume grease chamber being defined by the flow passage between them. It is desirable to provide a single ram BOP having both the capability of elastomer sealing and grease sealing with the wireline and also having the capability of being hydraulically opened and closed by a selectively operably hydraulic system and which incorporates a secondary hydraulic system for accomplishing grease pressure energized, hydraulically induced enhancement of the closing force of the opposed rams of the BOP.

Hydraulically energized wireline BOP systems ordinarily require a BOP design having a very large ram element and a special outer seal which can significantly increase the complexity and cost of a wireline BOP in comparison with more conventional BOP systems. It is desirable therefore to develop a ram element for a BOP mechanism which serves the grease injection requirement as well as BOP mechanisms having large ram elements but which is of substantially the same size as that of an existing generic wireline BOP. This feature will provide the very desirable results of (a) allowing the use of a standard sized outer seal for the rams (b) fitting of the structural components of the rams into a standard diameter ram body and (c) allowing the use of a standard diameter blowout preventer body. All of these factors materially influence the cost and thus the competitive nature of the BOP mechanism.

It is therefore a primary feature of the present invention to provide a novel wireline BOP having a controllable hydraulic system for selective opening and closing the rams such as for testing or closing under well pressure and having a grease pressure energized system for enhancing the closing force of the rams against the wireline to thus provide for grease pressure enhanced sealing thereof.

It is another feature of the present invention to provide a novel single ram wireline BOP construction having rams that are designed both for elastomer sealing with the wireline and grease sealing with the wireline and yet which utilizes rams of sufficiently small dimension as to be dimensionally comparable with a generic wireline blowout preventer.

It is also a feature of the present invention to provide a novel single ram wireline BOP, whether energized by selective hydraulic operation or by automatic well pressure responsive, piston energized operation, which achieves an efficient mechanical seal about braided wireline to efficiently contain well pressure below the rams.

It is also a feature of this invention to provide a novel single ram wireline BOP that, when closed, defines a small volume grease chamber located between spaced elastomer seals of the ram to thus provide the capability of grease injection about the wireline to thus provide an additional hydraulic seal about the wireline cable to prevent the flow of gases through the interstices formed by the armor of the cable.

It is an even further feature of this invention to provide a novel single ram wireline BOP incorporating both mechanical and hydraulic sealing and wherein hydraulic sealing is effected quickly by means of a minimal volume of injected grease.

SUMMARY OF THE INVENTION

The various principles of the present invention are realized in the provision of a single ram grease injection type wireline blowout preventer having only a single set of opposed blowout preventer rams as compared with dual and triple ram BOP's such as have been employed in the past. The hydraulically energized wireline BOP of the present invention incorporates a body structure having opposed hydraulically energized ram actuators each having driving connection with one of the two internal rams of the BOP apparatus. The hydraulically energized ram actuator mechanisms are in the form of hydraulically energized BOP operators with non-rising stem manual backups.

Each of the rams is basically composed of a suitable metal such as steel, stainless steel, etc. and incorporates elastomer and metal inserts that are typically retained within the rams and are disposed for movement along with the rams into sealing engagement with a wireline that extends through the flow passage of the BOP body. The rams are so designed that a grease sealing chamber is developed between upper and lower elastomer seals of the rams when the rams are in sealing assembly with the wireline. This grease sealing chamber is of small dimension and is capable of containing only a small amount of grease or other suitable sealing material. A grease injection valve or fitting is connected in assembly with the body structure of the BOP and receives grease or any other suitable flowable sealant from a source such as a hydraulic hand pump or a hydraulically or electrically energized grease injection pump. The grease injection valve is a unidirectional valve disposed in communication with the grease sealing chamber via grease channels in the faces of the rams and thus permits grease to be injected into the grease chamber and about the wireline with sufficient force to penetrate the interstices of the braided wireline and establish a grease seal that enhances the mechanical seal established by the elastomer sealing elements of the rams.

The BOP system also incorporates an equalizing valve assembly permitting controlled equalization of pressure of the upstream and downstream flow passages even when the BOP is maintained in sealed relationship with the wireline via the closed rams and the pressurized grease within the grease sealing chamber. The equalizing valve assembly is defined by a manually operable needle valve assembly which controls communication through bypass passages defined by the body structure of the BOP.

The wireline BOP system of the present invention achieves hydraulically energized ram force enhancement by a system for deliberately ducting grease from the grease sealing chamber defined by the rams through passages in the rams and to cylinders located behind the rams and having free pistons that act directly on the rams in response to grease pressure. The ducted grease acts upon the sealing area defined by inner and outer seals of the pistons and develops a piston induced force acting on the rams that is significantly greater than the grease pressure induced force acting oppositely on the sealing forces of the rams. This causes the grease pressure induced piston to apply closing forces on the rams which is always greater than the oppositely directed grease pressure induced force acting oppositely on the rams because of a great difference in the opposing pressure responsive areas of the free pistons and the sealing faces of the rams.

Even though the rams effectively accomplish both elastomeric sealing and grease sealing with the wireline the physical dimension of the rams is substantially the same as that of an existing generic wireline blowout preventer. For this reason a standard sized outer seal may be employed and the ram body structure may have a diameter that is approximately the same as that of a conventional wireline BOP. This feature also allows the use of a standard diameter blowout preventer body. Thus the physical dimension and the resulting cost of the single ram blowout preventer construction of the present invention will be approximately the same as that of conventional blowout preventers having ram type elastomer sealing but lacking the efficient grease pressure enhanced sealing capability of the present invention.

There is thus provided a wireline blowout preventer system incorporating a single pair of opposed rams that have unidirectional sealing capability about a wireline by means of elastomeric seals. The apparatus also incorporates in this single BOP ram assembly a grease sealing capability permitting high pressure injection of grease into a central grease chamber formed between upper and lower seals of the rams to thus permit hydraulic sealing of the interstices of the wireline. This apparatus accomplishes in a single BOP ram assembly the features that are ordinarily provided in dual and triple BOP systems.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the Drawings

FIG. 1 is a sectional view of a wireline blowout preventer mechanism constructed in accordance with the principles of this invention and incorporating both mechanical and hydraulic sealing about the wireline and incorporating grease pressure enhanced sealing of the opposed rams with one another and with the wireline;

FIG. 2A is an enlarged sectional view illustrating one ram operating mechanism of the wireline blowout preventer in detail;

FIG. 2B is a partial sectional view of the BOP construction of FIGS. 1 and 2, illustrating the opposed rams in the closed positions thereof about the wireline and showing each of the grease energized pistons thereof in a position of ram closing actuation;

FIG. 3 is a front elevational view of the packing capsule of the BOP construction of FIGS. 1 and 2;

FIG. 4 is a sectional view taken along line 4—4 of FIG. 3;

FIG. 5 is a side elevational view of the packing capsule of FIGS. 3 and 4;

FIG. 6 is a plan view of the packing capsule of FIGS. 3-5;

FIG. 7 is a side view of the ram body shown with the packing capsule separated therefrom;

FIG. 8 is a plan view of the ram body of FIG. 7;

FIG. 9 is a bottom view of the ram body of FIGS. 7 and 8;

FIG. 10 is a front elevational view of the ram body of FIGS. 7-9;

Figure 1:
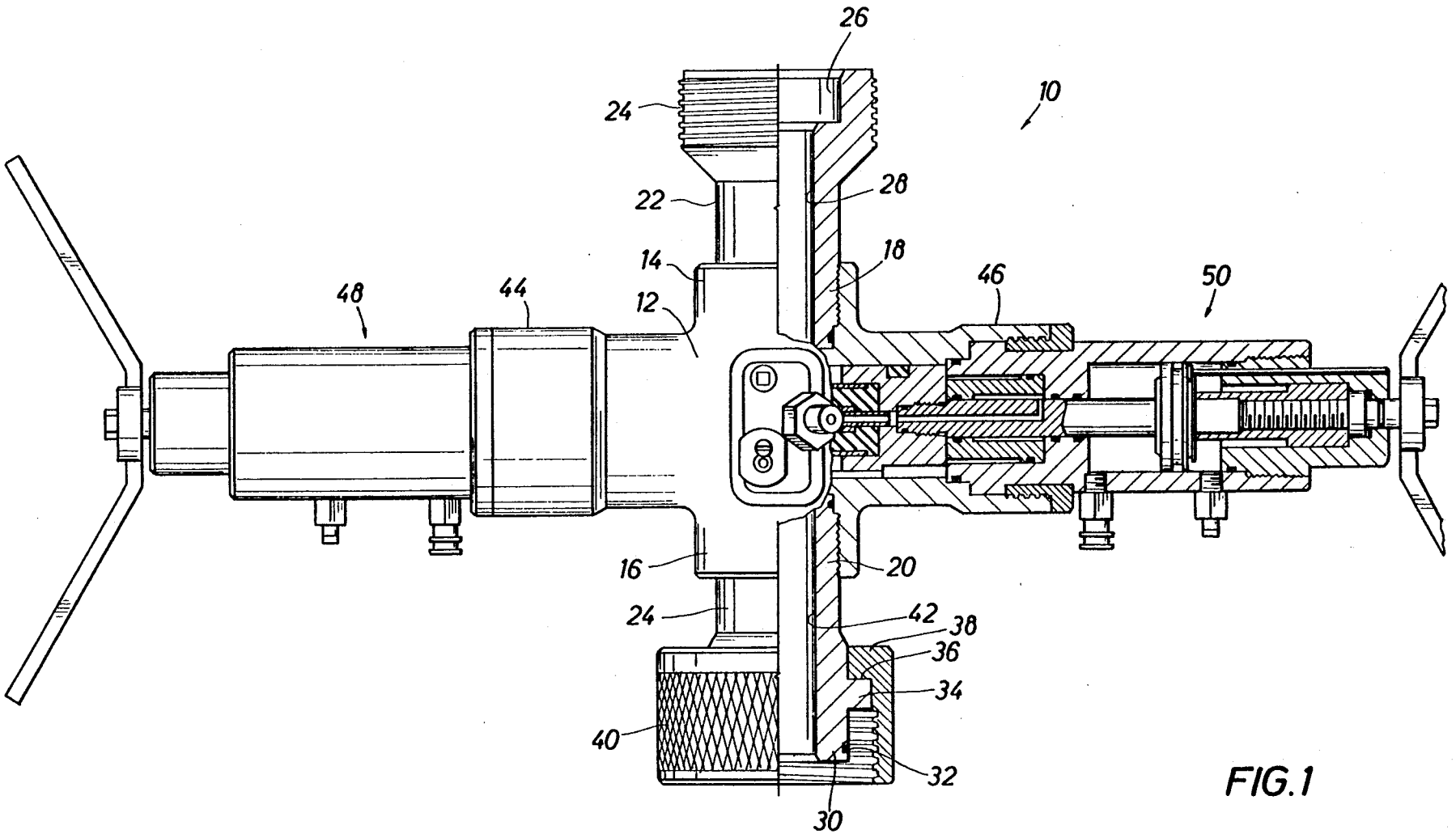
Figure 2A:
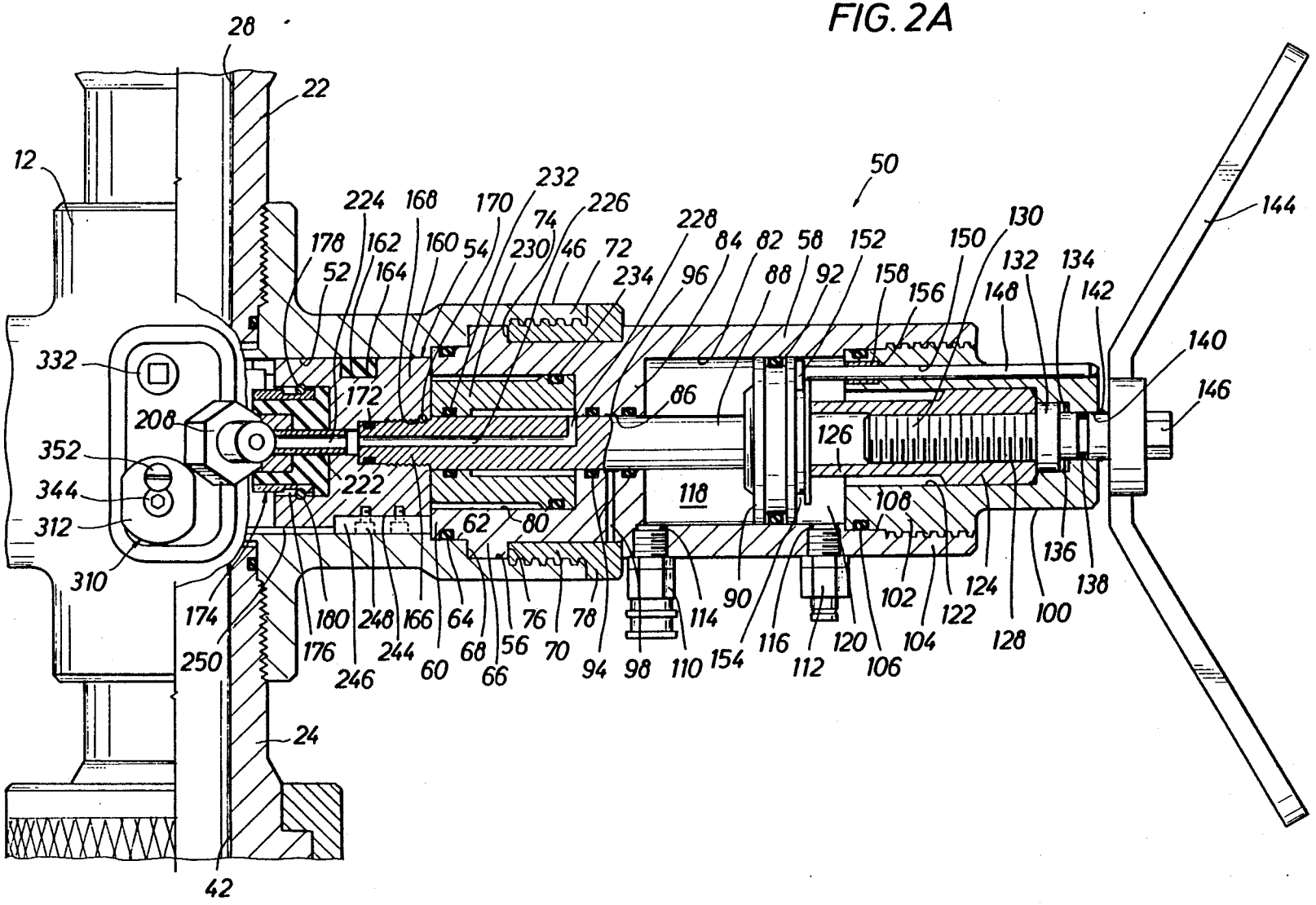
Figure 2B:
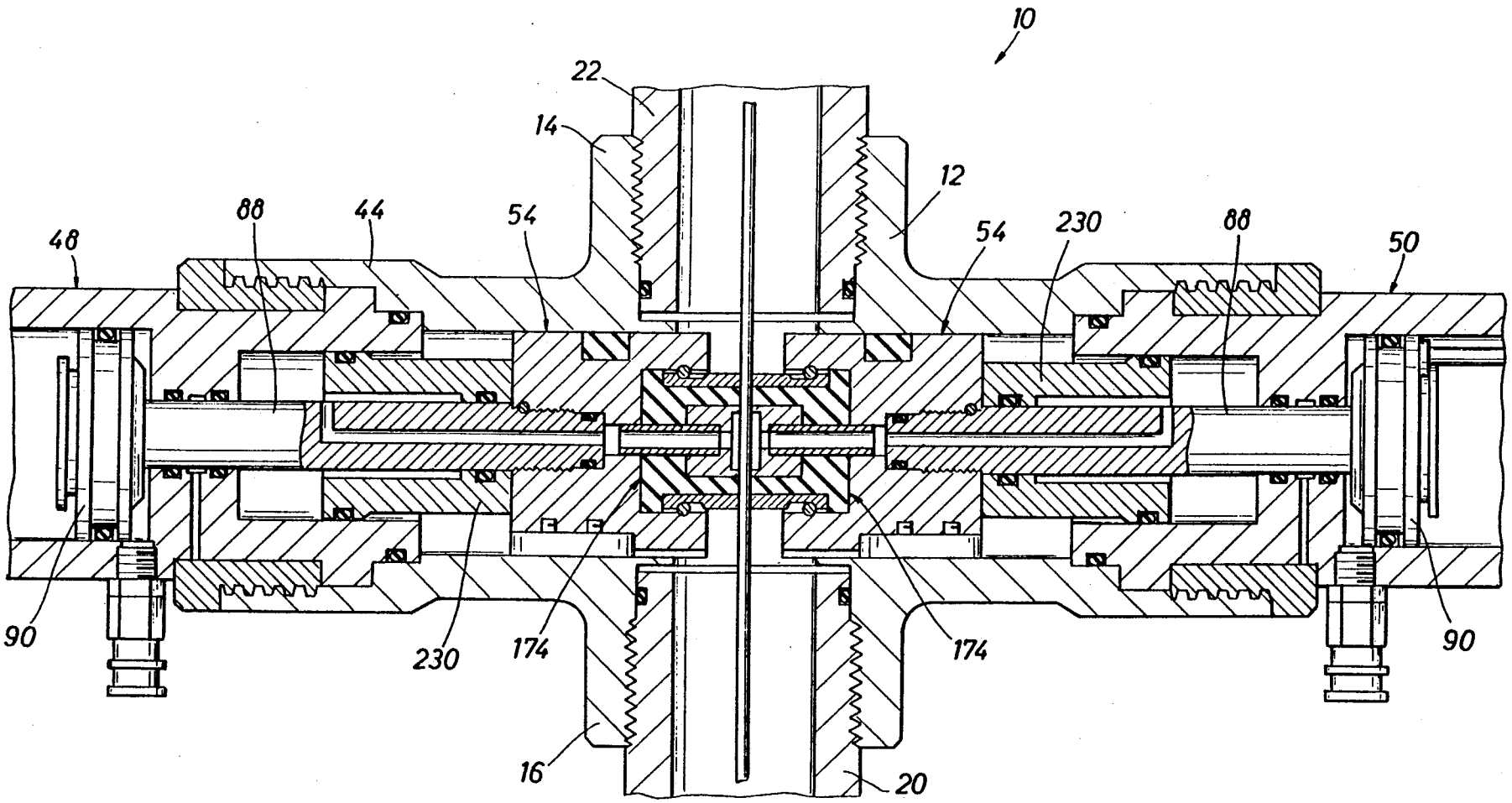
Figure 3:
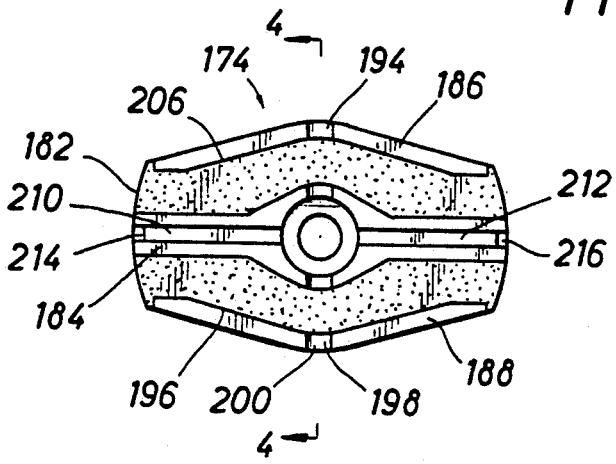
Figure 7:
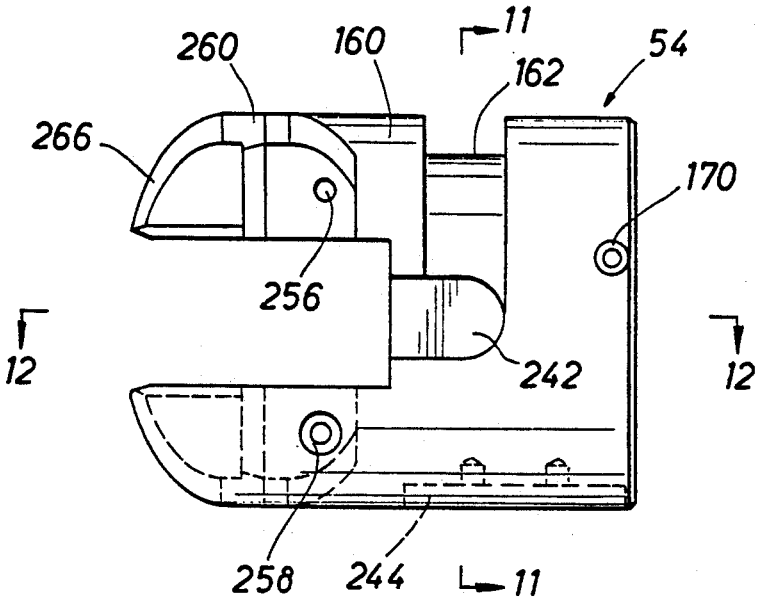
Figure 8:
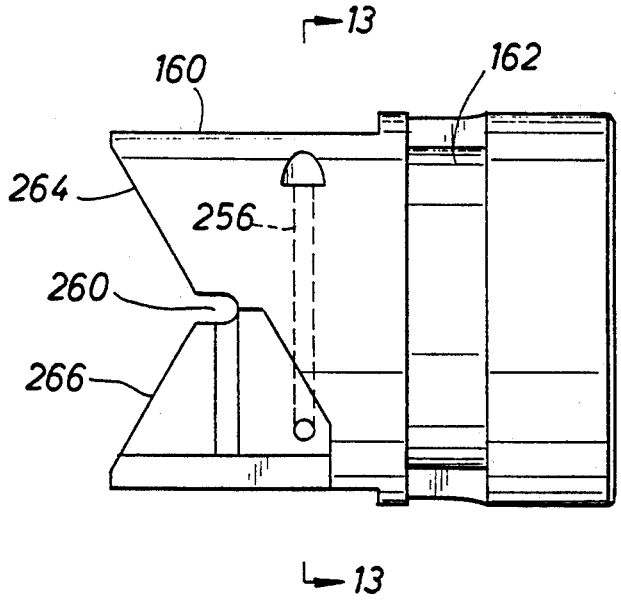

FIG. 11 is a sectional view taken along line 11—11 of FIG. 7;

FIG. 12 is a sectional view taken along line 12—12 of FIG. 7;

FIG. 13 is a sectional view taken along line 13—13 of FIG. 8;

FIG. 14 is an elevational view of the elastomeric outer seal which is employed in the opposed rams of the BOP;

FIG. 15 is a plan view of the outer seal of FIG. 14;

FIG. 16 is a sectional view taken along line 16—16 of FIG. 14;

FIG. 17 is a fragmentary sectional view of the BOP body structure of FIGS. 1 and 2 and which incorporates a grease injection valve assembly also shown in section; and FIG. 18 is also a fragmentary sectional view of the BOP body structure showing the equalizer value mechanism thereof in detail.

DETAILED DESCRIPTION OF PREFERRED EMBODIMENT

Referring now to the drawings and first to FIG. 1, a single ram grease pack BOP system having grease pressure enhanced sealing capability is illustrated generally at 10 and incorporates a BOP body structure 12 having upper and lower connections 14 and 16 for assembly of the BOP into wellhead apparatus or into respective upper and lower components of a wireline barrel.

The upper and lower body connections 14 and 16 are internally threaded and respectively receive externally threaded sections 18 and 20 of connectors 22 and 24. The upper connector 22 is referred to as a box connector and is externally threaded as shown at 24 for the purpose of receiving the internally threaded connecting collar of a BOP barrel or other connecting sub having its pin connection received within the box receptacle 26. The box connector defines an internal passage 28 through which the wireline cable passes. The lower connector 24 may be referred to as a pin connector having a depending pin 30 which is received within the connection box of an adjacent tubular connector and which is sealed therewith by a circular sealing element such as an O-ring which is carried within an external groove of the pin. The pin connector 24 also has a circular external flange 34 which defines an upwardly directed thrust shoulder 36 that receives thrust force from the inwardly directed flange portion 38 of an internally threaded connection collar 40. Thus, the wireline BOP mechanism 10 is connected to other tubular components such as a wireline riser barrel or adjacent wireline BOP by means of box and pin connections that are secured by means of easily tightened and loosened connection collars. The pin connector 24 also defines an internal passage 42 through which the wireline cable passes when the BOP mechanism is installed on a wellhead structure.

The BOP body structure 12 also defines a pair of laterally projecting opposed body connections 44 and 46 which function as opposed supports for substantially identical hydraulically energized opposed ram assemblies each shown generally at 48 and 50 respectively. For the purpose of simplicity, only one of the ram assemblies is discussed herein in detail in connection with FIG. 2. The body connector 46 is formed to define an internal receptacle having an internal cylindrical section 52 for receiving a ram assembly shown generally at 54 and having an outer enlarged diameter section 56 for receiving the inner portion of a hydraulic cylinder 58. The inner portion of the hydraulic cylinder defines a cylindrical connecting pin or projection 60 which is sealed with respect to an internal cylindrical surface 62 by means of a seal ring assembly 64 that is present within an external seal groove of the connecting pin 60. The internal portion of the hydraulic cylinder 58 also defines an annular flange 66 which is adapted to be secured against an internal thrust shoulder 68 of the body connector 46 by means of an externally threaded split retainer ring 70 that is received by an internally threaded outer section 72 of the connector. The retainer ring 70 defines a circular shoulder 74 which applies thrust force to an annular shoulder 76 of the flange 66. The retainer ring 70 defines a plurality of external receptacles 78 for receiving a suitable tool such as a spanner tool, for example, for the purpose of tightening and loosening the retainer ring relative to the internal threads of the threaded section 72. The retainer ring thus retains the hydraulic cylinder structure 58 in secured and sealed relation with respect to the body connector 46.

The hydraulic cylinder defines an internal, secondary cylinder 80 and an external primary cylinder 82 having a body partition 84 disposed therebetween. The body partition 84 defines a central passage 86 through which extends the movable piston stem 88 of a hydraulic piston 90. The hydraulic piston is sealed with respect to the internal cylindrical surface defining the outer piston chamber 82 by means of a high pressure seal assembly 92 located within an external seal groove of the piston. The piston stem is sealed with respect to the centrally oriented passage 86 of the partition 84 by means of a pair of spaced circular sealing elements 94. In the event either of the seals 94 should develop a leak, any leaking hydraulic fluid or grease as the case may be, will enter a leak connection annulus 96 and will then be conducted by a leak discharge passage 98 where it exits in the vicinity of a circular recess within which the retainer ring 70 is located. Any leakage at this point will provide clear indication that one of the piston stem seals 94 is leaking and the character of leaking hydraulic fluid or grease will indicate which of the seals is leaking.

The outer piston chamber 82 is closed by means of an end cap 100 having an externally threaded inner section 102 which is received by the internally threaded outer extremity 104 of the hydraulic cylinder. The end cap is sealed with respect to the hydraulic cylinder by means of a circular seal assembly 106 which is contained within an annular external seal groove located at the inner portion of the end cap and which seals against an internal cylindrical surface 108 of the hydraulic cylinder.

For hydraulic energization of the piston 90, hydraulic connectors 110 and 112 are received by threaded body passages 114 and 116 of the hydraulic cylinder and are therefore in respective communication with internal hydraulic chambers 118 and 120 on opposite sides of the piston. To ensure against improper connection of hydraulic supply and return hoses thereto, hydraulic connector 110 is of the female type while hydraulic connector 112 is of the male type. Each of these hydraulic connectors is of the quick disconnect variety, thus enabling simple and efficient connection of hydraulic supply and return lines thereto. It should be borne in mind that each of the hydraulic lines is both a supply and return line depending upon whether the rams of the BOP are being opened or closed. For opening of the rams the connector 110 becomes the inlet connector while the connector 112 functions to return hydraulic fluid from the chamber 120 to a suitable reservoir. Hydraulic connector 112 becomes the inlet connector for injection of pressurized hydraulic fluid into the chamber 120 for moving the piston 90 in a direction closing the ram 54 while the connector 110 returns hydraulic fluid from the chamber 118 to the reservoir.

The wireline BOP of the present invention is provided with a mechanism for locking the piston 90 in the ram closing position and also for providing a mechanism ram closing force in the event such becomes desirable even though it is not intended as a manual operator. For this purpose the end cap 100 defines an internal receptacle 122 containing a non-rising stem piston lock and actuator mechanism. For this purpose an elongate nut 124 having an elongate tubular section 126 is movably located within the receptacle 22 and defines an externally threaded outer section 128 which is disposed in threaded engagement with the external threads of a non-rising stem 130. The stem 130 defines an external thrust flange 132 which is disposed in rotatable support with an internal annular shoulder 134 of the end cap by means of a circular thrust washer 136 or other suitable thrust bearing. The non-rising stem 130 is sealed with respect to the end cap by means of a circular seal assembly 138 which is positioned within a circular external seal groove defined within the non-rising stem and which seals against an internal cylindrical surface 140. While the internal shoulder 134 restricts outward movement of the non-rising stem 130, inward axial movement of the stem is restricted by a retainer ring 142 such as a split ring which is retained within a circular external groove of the non-rising stem. An operating handle 144 is secured in non-rotatable relation with the non-rising stem 130 by means of a lock nut 146. Selective rotation of the operating handle 144 causes the threaded actuating stem to drive the nut 124 axially within the receptacle 122. The piston locking nut 124 is non-rotatably received within the receptacle 122 and thus can only move linearly upon rotation of the non-rising stem 130.

It is desirable to provide a visual indication of the position of the piston 90 and thus the ram 54 so that it may be visually determined whether the ram is open or closed or whether it is moving during hydraulic opening or closing thereof. This is accomplished by a position indicator rod 148 which is linearly movable within a passage 150 extending through the end cap 100. An inner head portion 152 of the position indicator rod 148 is received within an annular recess 154 of the piston to ensure that the position indicator moves along with the piston. The position indicator rod 148 is sealed with respect to the end cap 100 by means of a circular sealing element 156 which is secured in sealed relation about the indicator rod by means of a seal retainer 158 that is threadedly received within the end cap 100.

The ram construction shown generally at 54 is provided with a ram body 160 defining an external recess 162 within which is received an external ram seal 164 for sealing against the internal cylindrical surface 52 of the BOP body. An internally threaded inner extremity 166 of the piston stem 88 is received by an internally threaded receptacle 168 within the ram body and is locked against axial movement relative to the ram body by means of a locking pin 170 received within a circular external groove of the piston stem. The inner extremity of the piston stem is sealed with respect to the piston body 160 by means of a circular seal assembly 172 which is carried within an external seal groove of the piston stem and seals against an internal cylindrical surface of the ram body 160.

Figure 4:
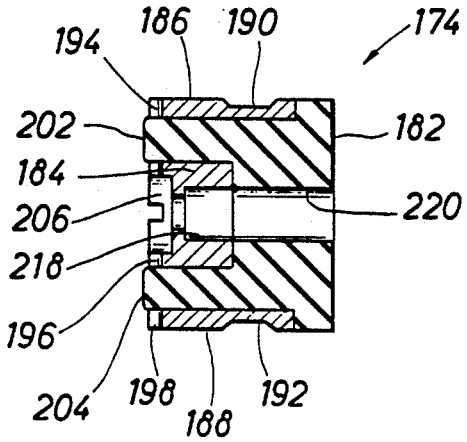
Figure 5:
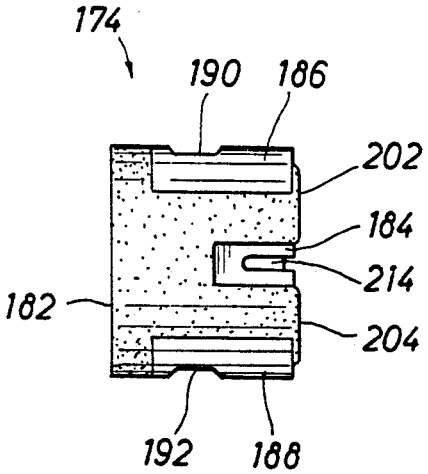
Figure 6:
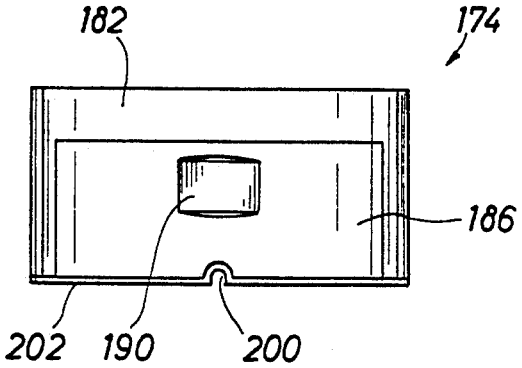

To provide for sealing of the ram 160 relative to the wireline which extends through the passages 28 and 42 a packing capsule shown generally at 174 in FIGS. 3–6 is retained within a packing receptacle 176 of the ram body by means of opposed retainer pins 178 and 180, as shown in FIG. 2A, which are received respectively within retainer pin passages that are defined within the ram body as shown in FIG. 7. The packing capsule is defined by a body of elastomeric material 182 which is composed of any one of a number of rubber or rubber like elastomeric materials that are suitable for the intended purpose. The elastomeric body 182 is molded or otherwise formed about a central body insert 184 composed of a suitable rigid material such as steel and having upper and lower outer rigid inserts 186 and 188 secured thereto by means of molding, bonding or by any other suitable means. The inserts 186 and 188 may also be composed of steel or any other suitable rigid material. The upper and lower inserts define centrally oriented recesses 190 and 192 respectively within which the retainer pins 178 and 180 are received as shown in FIGS. 1 and 2. These recesses are of considerable length to thereby allow axial movement of the inserts relative to the ram body 160 as the elastomeric material is deformed during high pressure sealing. The inserts also define spaced recesses 194, 196 and 198 respectively as shown in FIG. 4, which cooperatively define a vertically oriented wireline retainer slot 200 as shown in FIG. 6. As shown in FIGS. 4 and 5 the elastomeric material forming the upper and lower seal portions 202 and 204 of the elastomer body project forwardly beyond the wireline recesses to an extent permitting deformation of the elastomer about the wireline at upper and lower spaced locations on the packing capsule. The central packing insert 184 defines a circular face recess 206 which defines a centralized grease chamber of relatively small volume. When the opposed rams come into face to face sealing with one another and with the wireline the central recesses 206 of each of the rams defines a small volume grease chamber into which grease is injected to enhance the sealing capability of the rams. The grease enters the interstices of the wireline cable and thus ensures sealing to prevent leakage of gas through the interstices defined by the cable strands. The grease is injected into the chamber defined by the opposed recesses 206 of the rams by means of a grease injector 208 which is shown in FIG. 2. A grease hand pump or other suitable grease pressurizing source is coupled with the grease fitting 208 to thus permit injection of pressurized grease into the centrally located chamber defined by the recesses 206 of the packing capsules. The central insert 184 is also formed to define a pair of aligned spaced recesses 210 and 212 which communicate with the central grease recess 206 and which function as grease passages to conduct injected grease material from the opposed sides of the packing capsule toward the central grease chamber. The recesses 210 and 212 are also in communication with side recesses 214 and 216 which function to conduct injected grease so as to fill all of the space between the upper and lower sealing portions 202 and 204 of the elastomeric body 182.

The packing capsule shown in detail in FIGS. 3–6 is also designed to duct grease pressure from the grease chamber 206 through the packing capsule for energization of a piston that enhances the sealing force to which the ram 54 is subjected. To accomplish this feature the central packing insert 184 defines a cylindrical bore 218 which is disposed in registry with a cylindrical bore 220 in the elastomeric sealing body. As shown in FIGS. 1 and 2 a transition tube 222 is received by the registering bores 218 and 220 and defines an internal passage 224 which conducts grease from the central chamber defined by the recesses 206 into a central passage of the ram body 160 which is in communication with a central grease passage 226 of the piston stem 88. The grease passage 226 includes a lateral passage section 228 which opens into the inner cylinder 80 of the hydraulic cylinder body 58. A free piston member 230 is located within the inner or secondary cylinder 80 and is sealed with respect to the external cylindrical surface of the piston stem by means of a circular internal seal 232 and is sealed with respect to the cylindrical cylinder surface 80 by means of an external circular sealing element 234. Thus, grease injected under pressure through the passages 224, 226 and 228 into the inner cylinder 80 act upon the pressure responsive area of the free piston which is defined by the inner and outer seals 232 and 234 thus developing a pressure induced force which urges the free piston toward the ram. This pressure responsive area is significantly greater than the pressure responsive area defined by the inner face portion of the packing capsule. Thus, when substantially the same grease pressure acts upon the smaller pressure responsive area of the packing capsule and the larger pressure responsive area of the free piston, a pressure induced force differential is developed which causes the free piston to be driven against the ram body 160 in such a manner that the force of the piston 90, tending to move the ram 160 toward its sealing relation with the wireline, is materially enhanced. The grease which is deliberately ducted from the grease chamber about the wireline is utilized to activate the ram energizing free piston 230. The piston then pushes the ram inward with a force that is always greater than the outward force because of a great difference in the two opposing pressure responsive areas of the free piston and the packing capsule.

Referring now to FIGS. 7–13 the ram structure shown generally at 54 is now described in detail. As shown in the side elevational view of FIG. 7 the top view of FIG. 8 and the bottom view of FIG. 9, the ram body is of generally cylindrical construction and is designed with the external seal groove 162 extending arcuately about the top portion thereof and encompassing about 180° of the upper peripheral portion of the ram body 160. The arcuate groove section 162 is in communication with opposed side seal recesses 240 and 242 so as to receive lateral external sealing portions having a mating configuration with the groove sections 162, 240 and 242. The exterior seal section filling the lateral recesses 240 and 242 have the sealing capability thereof enhanced by grease conducted thereto by the grease passages 214 and 216 of the packing capsule.

Figure 9:
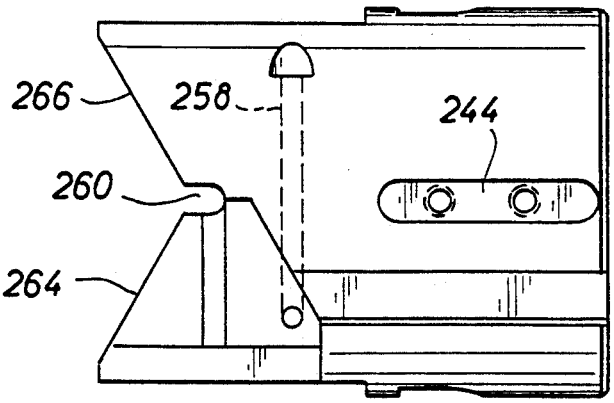

As seen from the bottom view of FIG. 9 and the sectional view of FIG. 11 the ram body 60 defines an elongate key recess 244 within which is received an elongate guide key 246 that is secured within the recess 244 by means of retainer screws 248. The guide key 246 is received within an elongate keyway 250 which is machined internally of the BOP body structure.

The ram body 160 further defines an internal passage or port 252 which is adapted to receive one extremity of the transition tube 222 as shown in FIG. 2. If desired the tube 222 may be in press fitted relation with the ram body 160. As seen from the front as shown in FIG. 10 the ram body 160 defines a recess or internal receptacle 254 within which is received the packing cartridge shown in FIGS. 3–6 with the packing cartridge being secured by transversely extending retainer pins 178 and 180 as shown in FIG. 2A that are received within respective retainer pin passages 256 and 258 as shown in FIGS. 8 and 13. As further shown in FIG. 10 the ram body defines vertically oriented passage sections or slots 260 and 262 which are adapted to receive the wireline as the rams move to the closed positions thereof. The rams also define respective angulated cam-like wireline guide surfaces 264 and 266 at the forward portions thereof which function to centralize the wireline in the event it is not centered when the rams begin their respective closing movements.

Referring now to FIGS. 14–16 an elastomeric outer seal 268 is shown which is received within the arcuate outer seal recess 162–240–242 of the ram body 160. The outer seal 268 is composed of any one of a number of suitable rubber or rubber like elastomeric sealing materials and incorporates an arcuate section 270 of generally rectangular cross-sectional configuration as shown in FIG. 16 and defines inner and outer generally cylindrical surface sections 272 and 274. At its lower end, and formed integrally therewith, are provided a pair of spaced lateral sections 276 and 278 which are received respectively within the lateral seal recess sections 240 and 242 of the ram body. The enlarged lateral sections 276 and 278 are formed to define rear arcuate configuration as shown at 278 to thus conform precisely with the configuration of the lateral recess sections 240 and 242. The outer seal 268 is typically a molded object which simply resides within the respective arcuate outer seal recess of the ram body 160 and is entrapped within its seal recess by the inner cylindrical surface 52 of the BOP body structure 12.

With reference now to FIG. 17 a grease injection valve mechanism is shown generally at 208 which incorporates a valve body structure 280 having an externally threaded extension 282 which is received in threaded assembly with an internally threaded opening 284 in communication with a grease injection passage 286. The grease injection passage is in communication both with the transverse bores 52 of the BOP body and with the passages 28 and 42 of the BOP connectors 22 and 24. With the rams closed, the rams cooperate to define a centrally oriented, small volume grease injection chamber which is in communication with the grease injection passage 286 by means of the horizontally oriented grease channels 210, 212, 214 and 216 of the packing capsule shown in FIGS. 3 and 5. The centrally oriented grease chamber is cooperatively defined by the central recesses 206 of the respective central packing inserts 184.

The grease injection valve body 280 defines a tapered internal seat 288 against which is seated a ball check 290 that is urged against its seat by means of a compression spring 292. The inner end of the compression spring is restrained by means of a retainer pin 294 which extends transversely through the internal connector portion 282 of the valve body. The check valve mechanism is thus arranged to permit injection of grease past the valve seat 288 and to seal against the flow of grease or well fluid in the opposite direction.

For the purpose of connecting the grease fitting 208 to a suitable source of pressurized grease, an externally threaded connector 296 is provided which includes a pin connection 298 that is received within a cylindrical receptacle of the valve body and is sealed therewith by means of a high pressure seal assembly 300. The connector fitting defines an intermediate shoulder 302 which is secured in shouldered relation against the outer extremity of the valve body structure 280 by means of an internally threaded retainer 304 which is received by the externally threaded outer section 306 of the valve body. Any suitable grease supply such as a hand pump type grease supply may be connected to the externally threaded connector and utilized to inject grease at a high pressure through the inlet passage 308 of the connector and past the check valve 290 and through the grease injection passage 286 to the centralized grease chamber defined by the packing capsule recesses 206 for grease sealing with the wireline and for grease pressure enhanced ram closure as described above.

It is frequently necessary with wireline BOP's to equalize pressure across the seal established between the wireline and the closed BOP rams such as for conducting particular downstream wireline barrel operations and especially to prepare the closed BOP rams for opening. It is typically difficult to move the rams against high differential pressure. Accordingly wireline BOP's must be provided with a bypass system that is utilized to equalize the pressure across the closed and sealed rams before the rams can be reopened. Upon equalization of well pressure across the seals developed by the closed BOP rams, pressure downstream of the rams will be contained by the wireline barrel and a partial relaxation of the BOP seals will occur thus eliminating pressure extrusion of the elastomeric sealing material of the rams about the irregular outer surface of the wireline and against the cylindrical inner surfaces of the ram housings and consequently reducing the friction of the rams against the internal wall surfaces of the BOP body structure. This effective reduction of friction minimizes the force that is necessary for opening of the rams.

As shown in FIG. 18 a pressure equalization system is shown which incorporates an equalizer valve assembly shown generally at 310 and which incorporates a valve body structure 312 having an externally threaded connecting structure 314 that is received by an internally threaded receptacle 316. The valve body 312 is sealed with respect to an upstream pressure bypass passage 318 by means of a circular high pressure seal assembly 320 which is received within an appropriate external seal recess of a valve body extension 322. The valve body is also sealed with respect to an internal cylindrical surface 324 which defines a portion of the equalizer valve receptacle of the BOP body 12 by means of a circular high pressure seal assembly 326 which is located within an outer circular seal groove of the equalizer valve body structure 312. The cylindrical outer portion of the receptacle defined by the cylindrical internal surface 324 is disposed in communication with a downstream bypass passage 328 by means of an equalizing passage 330. Externally, the bypass passage 328 is closed by means of an externally threaded closure plug 332.

The valve body structure 312 defines an internal equalizing passage 334 which is in communication with a transverse passage 336 of the valve body across a circular valve seat 338. The tapered sealing extremity 340 of a valve needle is movable into high pressure, substantially line contact sealing with the sharp circular valve seat 338. The valve needle 342 is disposed for linear movement within the receptacle so as to minimize wear of the valve seat and the tapered valve surface and is retained within the equalizer valve body by means of an Allen type retainer element 344 which is received by the internally threaded outer portion 346 of the needle receptacle. For opening and closing the needle valve 342, a recessed screw 348 is received in threaded engagement by the outer portion of the needle. As the screw 348 is rotated, the needle is moved linearly so as to seat or unseat the tapered sealing extremity 340 thereof with respect to the circular valve seat 348. The needle 342 is sealed with respect to the valve body 312 by means of a circular cup seal 350 which is arranged so that its sealing capability is enhanced by the pressure to which it is subjected. The needle retainer 344 is prevented from inadvertent separation from the equalizer valve body 312 by means of a retainer screw 352 having its head portion overlying the threaded receptacle 346. The retainer element 344 is threaded into its receptacle 346 sufficiently to place the conical sealing portion 340 of the needle in close proximity to the circular seat 338. The valve operating screw 348 is then engaged with a suitable screwdriver or other suitable tool for opening and closing the needle with respect to the needle seat.

OPERATION

The opposed rams of the BOP are both opened and closed by injection of hydraulic pressure into the respective piston chambers 118 and 120. For closing, hydraulic pressure is injected through the quick disconnect fitting 112 into the piston chamber 120 to thus develop hydraulic pressure induced force acting on the piston 90 thus driving the piston stem 88 and the ram body 160 toward its closed position until such time as the packing capsules 174 of the opposed rams come into face to face sealing contact. With the rams closed in this manner the packing capsules cooperate to define a centrally oriented grease chamber through which the wireline extends. Upon closure of the rams, if the wireline is not centered within the passages 28 and 42 the upper and lower angulated guide or cam surfaces 264 and 266 cause centering of the wireline so that it is received within the wireline recess 260 of the body and is thus disposed in registry with the vertical wireline passage of the packing capsule.

With the rams in face to face, sealing assembly the upper and lower face sealing portions 202 and 204 of the opposed rams engage and establish sealing with one another and with the wireline. These seals are located above and below the grease chamber defined by the recesses 206 of the central packing inserts. At this point grease is injected through the grease fitting 208 into the centrally oriented grease chamber to thus establish a small volume of highly pressured grease that penetrates the interstices of the wireline strands and thus establishes a positive seal with the wireline.

When the rams are closed and sealed the lockout mechanism may be activated by rotating the handle 144 to rotate the stem 130 and drive the nut 124 to a position where the nut extension 126 engages and secures the piston 90 in its ram closed position. By providing non-rising stem lockout mechanisms the lockout system is protected from damage by external objects.

The sealing capability of the rams with respect to one another is enhanced by grease pressure which is conducted via passages 224, 226, and 228 into a piston chamber defined by an inner cylinder 80 of the hydraulic cylinder body 58. This grease pressure acts upon the pressure responsive area of a free piston 230 defined by inner and outer seals 232 and 234 thereby causing the piston to be forced against the outer portion of the ram body 160. The pressure responsive area of the piston is larger than the pressure responsive area of the face portion of the packing capsule of the ram thus developing a resultant force acting to urge the ram 54 in tight, positively sealed relation with the opposed ram thus significantly enhancing the sealing capability of the blowout preventer. Thus the sealing capability of the rams is determined not only by the force developed thereon by the hydraulically energized piston 90 but also by the grease pressure induced resultant force acting against the rams by the respective grease pressure operated pistons.

When it is desirable to open the blowout preventer by retracting the rams 54 the blowout preventer must be pressure balanced. This is achieved by opening the equalizer valve assembly by rotating the operating screw 348 to cause retraction of the tapered sealing extremity 340 thereof from the circular valve seat 338. Opening the equalizer needle valve permits upstream pressure to bypass the blowout preventer rams via equalizer passages 344, 324, 336 and 330. After pressure equalization has been accomplished hydraulic opening pressure is introduced through fitting 110 into the piston chamber 118 thereby forcing the piston 90 rearwardly and expelling hydraulic fluid from the piston chamber 120 through the fitting 112. Obviously, movement of the piston 90 can occur only if the mechanical piston locking mechanism including the operating stem 130 and locking nut 124 has been retracted to or near the position shown in FIG. 2A.

As the piston 90 is moved toward its opened position by hydraulic pressure, the piston stem causes retraction of the ram 54 thus moving the ram body 60 toward its retracted position. The ram body during such movement also applies its opening force to the floating piston 230 thereby moving the floating piston toward its fully seated relation within the inner cylinder 80 and thereby expelling grease from the inner cylinder through the grease passages 228, 226 and 224 to the central bore of the BOP mechanism. At this point an operating cycle including hydraulically energized closing and hydraulically energized opening of the BOP ram mechanism has been disclosed. Additionally, the grease pressure induced sealing enhancement of the BOP mechanism has also been discussed in detail. It is therefore seen that this invention is one well adapted to accomplish all of the various features that has been described above.

Since certain changes or modifications may be made in the disclosed embodiment without departing from the inventive concepts involved, it is the aim of the appended claims to cover all such changes and modifications falling within the true spirit and scope of the present invention.

What is claimed is:

1. A wireline BOP mechanism having sealing capability with respect to a wireline that is movable therethrough and which forms interstices between armor strands thereof, comprising:

(a) a BOP body having a vertical flow passage and forming a pair of opposed horizontal ram passages;

(b) a pair of rams being movably disposed within said ram passages, each of said rams having elastomeric sealing elements adapted for sealing engagement with the wireline, said rams adapted to cooperatively form a grease chamber therebetween and being movable to an open position wherein said elastomeric sealing elements are positioned away from said wireline and a closed position where said elastomeric sealing elements establish sealing engagement with said wireline;

(c) means for imparting opening and closing forces to said rams and causing movement of said rams to said open and closed positions;

(d) means for injecting grease into said grease chamber at sufficiently high pressure to establish hydraulic sealing with said wireline in said grease chamber to prevent leakage of fluid pressure through said interstices of said wireline; and (e) means for enhancing said closing force of said rams in response to the pressure of grease within said grease chamber.

2. The wireline BOP mechanism of claim 1 wherein said means for enhancing said closing force comprises:

(a) means defining a secondary ram actuator for each of said rams and having a pressure responsive area, said secondary ram actuator applying the force of pressure acting on said pressure responsive area of said secondary ram actuator against said ram in a direction engaging said ram toward the closing direction thereof; and (b) means for ducting pressurized injected grease from said grease chamber to said pressure responsive area of said secondary ram actuator.

3. The wireline BOP mechanism of claim 1, wherein said means for enhancing said closing force of each of said rams comprises:

(a) a secondary piston chamber being defined by said BOP body;

(b) a secondary piston being movably located within said secondary piston chamber and defining a pressure responsive area; and (c) a ducting passage being in communication with said grease chamber and also being in communication with said secondary piston chamber at a location causing pressurized grease from said grease chamber to act on said pressure responsive area and urge said secondary piston toward said ram.

4. The wireline BOP mechanism of claim 1, wherein: said ducting passage extends through said ram.

5. The wireline BOP mechanism of claim 1, wherein:

(a) said ram defines a seal receptacle;

(b) a seal cartridge being disposed within said seal receptacle and including upper and lower vertically spaced elastomeric seals for developing spaced seals with said wireline, said grease chamber being defined between said spaced seals;

(c) a secondary piston chamber being defined by said BOP body;

(d) a secondary piston being movably positioned within said secondary piston chamber and defining a pressure responsive area; and (e) a grease deducting passage being in communication with said grease chamber and extending through said seal cartridge and said ram, said grease ducting passage being in communication with said secondary piston chamber at a location directing pressurized grease forced through said grease ducting passage to act on said pressure responsive area and develop a force urging said secondary piston against said ram thus providing said means for enhancing said closing force of said ram.

6. The wireline BOP mechanism of claim 1, wherein: said means imparting opening and closing forces to each of said rams comprises:

(a) a primary piston chamber being defined by said BOP body;

(b) a primary piston being located within said primary piston chamber and having a piston stem being connected in operating relation with said ram;

(c) a secondary piston chamber being defined by said BOP body;

(d) a secondary piston being movably disposed within said secondary piston chamber and having one end thereof adapted for contact with said ram, said secondary piston defining a pressure responsive area; and (e) said means for enhancing said closing force of said ram including duct passage means disposed in communication with said grease chambers and with said secondary piston chamber, said duct passage means directing said pressure of said grease to act on said pressure responsive area of said secondary piston, thus forcing said secondary piston against said ram in a direction with a force adding to the closing force of said ram induced by said primary piston.

7. The wireline BOP mechanism of claim 6, wherein: said duct passage means extending through said ram.

8. The wireline BOP mechanism of claim 6, wherein: said duct passage extending through said ram and said piston stem.

9. The single ram unidirectional wireline BOP system recited in claim 1, wherein:

(a) said BOP body forms a grease injection port in communication with said grease chamber; and (b) a unidirectional grease fitting being secured to said BOP body at said grease injection port and providing for said conducting injected grease into said grease chamber.

10. The wireline BOP mechanism of in claim 9, wherein:

said rams define grease chambers and central recesses cooperatively defining grease passages and cooperatively defining said grease chamber, said grease passages being in communication with said grease fitting and conducting injected grease therefrom to said grease chamber.

11. The wireline BOP mechanism of claim 1, including:

pressure equalizing means being in communication with said vertical flow passage upstream and downstream of the wireline seal developed by said rams and being controllable to selectively bypass fluid pressure past said wireline seal when said rams are at the closed position thereof establishing sealing engagement with said wireline.

12. The wireline BOP mechanism of claim 1, including:

a mechanical lock mechanism for securing said rams in the closed positions thereof.

13. The wireline BOP mechanism of claim 12, wherein said mechanical lock mechanism comprises:

(a) an operating stem being disposed in rotatable relation with said BOP body;

(b) a lock element having threaded connection with said operating stem and being driven linearly within said BOP body upon rotation of said operating stem, said lock element being engageable with said means for imparting opening and closing force to said rams and being adapted for securing said means and thus said rams against movement toward the ram opening positions thereof.

14. The wireline BOP mechanism of claim 13, wherein:

said operating stem is a non-rising type operating stem being supported in non-rotatable, linearly restrained relation with said BOP body.

15. A method for establishing a grease pressure enhanced seal between the opposed rams of a wireline BOP mechanism having upper and lower internal sealing elements for establishing spaced sealing with a wireline forming interstices between the armor strands thereof, said opposed rams when in sealing relation with said wireline, establishing a grease chamber therebetween, said method comprising:

(a) imparting closing movement to said rams thus bringing said upper and lower internal sealing elements of said rams into sealing engagement with one another and sealing engagement with said wireline;

(b) injecting a quantity of grease through said BOP body into said grease chamber for establishment of interstitial sealing with said wireline to prevent leakage of fluid pressure through said interstices; and (c) utilizing the pressure of said injected grease for enhancing the closing force and thus the sealing capability of said rams with said wireline.

16. The method of claim 15, wherein:

said wireline BOP mechanism includes a secondary piston chamber having a secondary piston therein, said secondary piston defining a pressure responsive area, said method including:

ducting grease pressure from said grease chamber and causing said grease pressure to act on said pressure responsive area and develop a pressure responsive force urging said secondary piston against said ram in a direction enhancing the sealing force of said ram.

17. The method of claim 16 wherein;

said wireline BOP mechanism includes a primary piston chamber having a primary piston chamber having a primary piston movable therein and having driving connection with said ram independently of said secondary piston and being hydraulically operable for opening and closing said ram, said method including:

(a) establishing equalized pressure within the flow passage of said BOP and across said rams to reduce frictional resistance to movement of said rams;

(b) imparting opening movement to said rams by hydraulic actuation of said primary piston;

(c) imparting closing movement to said rams by hydraulic actuation of said primary piston; and (d) with said rams closed and sealed about said wireline injecting grease into said grease chamber to establish a grease seal with said rams and wireline and conducting the pressure of said grease to said pressure-responsive area of said secondary piston.

18. A wireline BOP mechanism having sealing capability with a wireline and having injected grease pressure closing force enhancement for enhancing the sealing capability thereof, comprising:

(a) a BOP body having a vertical flow passage and forming a pair of tubular housings defining opposed horizontal ram passages;

(b) a pair of rams being movably disposed within said ram passages, each of said rams having a pair of vertically spaced elastomeric face sealing elements adapted for mechanical sealing engagement with a wireline, said rams being adapted to cooperatively define a grease chamber therebetween through which said wireline extends when said rams are closed, said rams being movable to an open position wherein said face sealing elements of said rams are positioned away from said wireline and a closed position where said face sealing elements of said rams establish sealing engagement with said wireline;

(c) primary operating means for imparting controlled movement of said rams to said open and closed positions;

(d) means for injecting grease into said grease chamber at sufficiently high pressure to establish sealing with said wireline in said grease chamber to prevent interstitial leakage of fluid pressure through said interstices of said wireline;

(e) secondary operating means for enhancing the closing force of said rams; and (f) means causing pressure induced actuation of said secondary operating means for enhancing the closing force of said rams responsive to injected grease pressure.

19. The wireline BOP mechanism recited in claim 18, including:

pressure equalization means being selectively operable for equalizing pressure within said flow passage and above and below the seals of said rams with said wireline.

20. The wireline BOP mechanism of claim 18 wherein said means for enhancing said closing force comprises:

(a) a secondary ram actuator for each of said rams defining a pressure responsive area, said secondary ram actuator being responsive to the force of grease pressure acting on said pressure responsive area for urging said secondary ram actuator against said ram in a direction urging said ram in the closing direction thereof; and (b) means for ducting pressurized injected grease from said grease chamber to said pressure responsive area of said secondary ram actuator.

21. The wireline BOP mechanism of claim 18, wherein said secondary operating means for enhancing said closing force of each of said rams comprises:

(a) a secondary piston chamber being defined by said BOP body;

(b) a secondary piston being movable located within said secondary piston chamber and defining a pressure responsive area; and (c) a ducting passage being in communication with said secondary piston chamber at a location causing pressurized grease from said grease chamber to act on said pressure responsive area and urge said secondary piston toward said ram.

22. The wireline BOP mechanism of claim 21, wherein:

said ducting passage extends through said ram.

23. The wireline BOP mechanism of claim 18, wherein:

(a) said ram defines a seal receptacle;

(b) a seal cartridge being disposed within said seal receptacle and including upper and lower vertically spaced elastomeric seals for developing spaced seals with said wireline, said grease chamber being defined between said spaced seals;

(c) a secondary piston chamber being defined by said BOP body;

(d) a secondary piston being movably positioned within said secondary piston chamber and defining a pressure responsive area; and (e) a grease deducting passage being in communication with said grease chamber and extending through said seal cartridge and said ram, said grease ducting passage being in communication with said secondary piston chamber at a location directing pressurized grease forced through said grease ducting passage to act on said pressure responsive area and develop a force urging said secondary piston against said ram thus providing said means for enhancing said closing force of said ram.

24. The wireline BOP mechanism of claim 18, wherein said primary operating means imparting controlled movement of said rams to said open end closed positions comprises:

(a) a primary piston chamber being defined by said BOP body;

(b) a primary piston being located within said primary piston chamber and having a piston stem being connected in operating relation with said ram; and (c) hydraulic means for controllably applying pressurized hydraulic fluid to said primary piston chamber for controlled movement of said primary piston thereon.

25. The wireline BOP mechanism of claim 24, including:

(a) a secondary piston chamber being defined by said BOP body;

(b) a secondary piston being movably disposed within said secondary piston chamber and having one end thereof adapted for contact with said ram, said secondary piston defining a pressure responsive area; and (c) said means for enhancing said closing force of said rams including duct passage means disposed in communication with said grease chamber and with said secondary piston chamber, said duct passage means directing said pressure of said grease to act on said pressure responsive area of said secondary piston, thus forcing said secondary piston against said ram in a ram closing direction with a force adding to the closing force of said ram induced thereto by said primary piston.

26. The wireline BOP mechanism of claim 25, wherein:

said duct passage means extends through said ram.

27. The wireline BOP mechanism of claim 25, wherein:

said duct passage extends through said ram and said piston stem.

28. The wireline BOP mechanism of claim 18, including:

a mechanical lock mechanism for securing said rams in the closed positions thereof.

29. The wireline BOP mechanism of claim 28 wherein said mechanical lock mechanism comprises:

(a) an operating stem being disposed in rotatable relation with said BOP body;

(b) a lock element having threaded connection with said operating stem and being driven linearly within said BOP body upon rotation of said operating stem, said lock element being engageable with said means for imparting opening and closing force to said rams and being adapted for securing said means and thus said rams against movement toward the ram opening positions thereof.

30. The wireline BOP mechanism of claim 29, wherein:

said operating stem is a non-rising type operating stem being supported in non-rotatable, linearly restrained relation with said BOP body.

* * * * *